US007475688B2

(12) United States Patent
Colacioppo et al.

(10) Patent No.: US 7,475,688 B2
(45) Date of Patent: Jan. 13, 2009

(54) HAIR TREATMENT APPLICATOR

(75) Inventors: Keith Colacioppo, White Plains, NY (US); Anne Marie Brangi, Orange, CT (US)

(73) Assignee: The Procter & Gamble Company, Cincinnati, OH (US)

( * ) Notice: Subject to any disclaimer, the term of this patent is extended or adjusted under 35 U.S.C. 154(b) by 419 days.

(21) Appl. No.: 10/949,832

(22) Filed: Sep. 24, 2004

(65) Prior Publication Data

US 2005/0066989 A1 Mar. 31, 2005

Related U.S. Application Data

(60) Provisional application No. 60/505,897, filed on Sep. 25, 2003.

(51) Int. Cl.
*A45D 24/04* (2006.01)

(52) U.S. Cl. ..... 132/126; 132/142

(58) Field of Classification Search ..... 132/126, 132/219, 112–116, 160, 161, 159, 158, 901, 132/141–142; D28/20, 7, 21, 9–10, 28–29, D28/25, 44.1, 56–57, 61–62, 99, 99.1
See application file for complete search history.

(56) References Cited

U.S. PATENT DOCUMENTS

| | | | | | |
|---|---|---|---|---|---|
| 3,760,821 | A | * | 9/1973 | Weddington | 132/118 |
| 4,605,026 | A | | 8/1986 | Nolin | |
| 4,702,265 | A | * | 10/1987 | Weddington | 132/118 |
| D341,676 | S | * | 11/1993 | Butts et al. | D28/28 |
| 5,337,765 | A | | 8/1994 | Wong | |
| D394,730 | S | | 5/1998 | Olsson | |
| 6,079,420 | A | | 6/2000 | Musum | |
| 6,142,157 | A | | 11/2000 | De Laforcade | |
| D442,331 | S | * | 5/2001 | Pannozzo et al. | D28/7 |
| 6,286,518 | B1 | | 9/2001 | Laporte | |
| D459,027 | S | * | 6/2002 | Chen et al. | D28/22 |
| 6,453,909 | B1 | | 9/2002 | De Laforcade | |
| 6,457,476 | B1 | * | 10/2002 | Elmer et al. | 132/114 |
| D474,561 | S | * | 5/2003 | Glucksman et al. | D28/7 |
| 6,688,314 | B1 | | 2/2004 | Hoeffkes | |
| D490,564 | S | | 5/2004 | Colacioppo | |
| 2004/0065338 | A1 | | 4/2004 | Colacioppo | |

FOREIGN PATENT DOCUMENTS

| | | | |
|---|---|---|---|
| FR | 2645725 | A1 | 10/1990 |
| GB | 2237036 | A | 4/1991 |
| JP | 2003206217 | | 7/2003 |

* cited by examiner

*Primary Examiner*—Robyn Doan
(74) *Attorney, Agent, or Firm*—Melissa Krasovec; Marianne Dressman; Tara M. Rosnell

(57) ABSTRACT

The invention relates to a hair treatment applicator for applying a hair treatment product composition to a user's hair by passing the applicator through the hair in a predetermined direction, where the applicator comprises a handle and a head connected to the handle, where the head includes a body having a base and a retaining structure, the retaining structure comprising a pair of opposed blades extending downwardly from the base and proximate the edges of the base, the pair of opposed blades being disposed coincident with the direction of use and the opposed blades defining a retaining volume adapted to receive the hair treatment product composition.

6 Claims, 6 Drawing Sheets

HAIR TREATMENT APPLICATOR

CROSS REFERENCE TO RELATED APPLICATION

The application claims the benefit of U.S. Provisional application Ser. No. 60/505,897 filed on Sep. 25, 2003.

BACKGROUND OF THE INVENTION

1. Field of the Invention

The present invention relates to hair treatment devices. More particularly, the present invention relates to hair treatment applicators and a method of applying a hair treatment product composition to hair. Especially, the present invention relates to hair treatment applicators for applying a thickened hair lightening product composition to long hair or curly, especially long, curly hair.

2. Description of the Prior Art

Hair treatment or hair color applicators are known. Such hair treatment applicators allow a user to apply a hair product, such as a highlightener, a hair bleach, or a hair dye, to hair.

U.S. Provisional Pat. Appln. 60/416,163 filed Oct. 4, 2002 and assigned to The Procter & Gamble Company, assignee herein, discloses an applicator for applying a highlighting composition to hair. The highlighting applicator of the '163 application has a handle, a plurality of heads connected to the handle, and a hair treatment composition retaining structure that comprises a plurality of tines defining a retaining volume. The tines defining the retaining structure of the '163 application are circular in cross section, and short in length. Consequently, while suitable for short hair styles, that device is not suitable for long or curly hair, especially for long, curly hair.

In U.S. Pat. No. 6,142,157 to de Laforcade, an applicator system is disclosed. The applicator has a handle with a brush, and a plurality of brush members extending from a first side of the brush. The brush members are disposed along the first side of the brush in parallel and perpendicular rows. A user places the hair product onto the brush members and passes the applicator along a lock of hair so that the brush members transfer the hair product to the hair. The disclosed applicator suffers from the drawback of failing to allow for a separation between treated and untreated hair.

In U.S. Pat. No. 6,079,420 to Musum, a highlighting comb is disclosed. The comb has a plurality of tines that are secured to a spine, which is connected to a handle. The tines are disposed adjacent to each other along a straight line. The user of the comb places the treatment material into retaining areas that are disposed between each of the respective adjacent tines and then passes the tines through the hair. The disclosed comb suffers from the drawback of failing to provide a separation between the retaining areas through which hair may pass that will be untreated.

When the hair is long, the conventional applicators do not penetrate the hair. Rather, the hair is pressed down, and the applicator head when used is pulled across the surface of the hair. With curly hair there is more entanglement of the strands, with the conventional applicators becoming caught in the hair. In both cases, there is a random distribution of the hair treatment product composition onto the surface of the hair, and with insufficient product being applied to the interior surface of the hair. In particular in extreme cases, the product will be dispensed onto the long hair as large globs, which will cause excessive amounts of the product to be applied locally rather than evenly distributed, resulting in poor aesthetics.

SUMMARY OF THE INVENTION

It is an object of the present invention to provide a hair treatment applicator that applies a hair treatment product uniformly to long hair.

It is another object of the present invention to provide such an applicator that applies a hair treatment uniformly to curly hair.

It is another aspect of this invention to provide an applicator suitable to retain thickened hair bleaching, hair lightening, hair highlighting, or hair dye product compositions in the retaining volume of such applicator and to apply such compositions to long and curly hair.

These and other objects and advantages of the present invention are provided by a hair treatment applicator that comprises a handle and a head connected to the handle, the head comprising a head body and a hair treatment composition retaining structure extending downwardly from the base of the head body, the retaining structure being designed in a manner adapted to penetrate through long hair and curly hair, and further is designed in a manner that facilitates gliding of the applicator through the hair to deposit a hair treatment product composition onto the hair uniformly.

The present invention is also a hair treatment applicator for applying hair treatment onto hair, the applicator comprising a handle and a head connected to the handle, the head comprising a head body and a retaining structure connected to the head body, the retaining structure being adapted to retain a thickened hair treatment product composition, and in use to apply such composition to long hair and to curly hair.

The present invention is also a hair treatment applicator for applying a hair treatment product composition onto hair, the applicator comprising an elongated handle and a head connected to the handle, the head having a body and a retaining structure, the retaining structure comprising at least one pair of opposed blades extending downwardly from the base of the head body proximate the edge of the base and substantially parallel to the direction of use of the applicator, the at least one pair of blades defining a retaining volume for holding the thickened hair treatment product composition.

These and further objects, advantages and features of the present invention will be understood by reference to the drawings and detailed descriptions that follow.

DETAILED DESCRIPTION AND PREFERRED EMBODIMENT OF THE INVENTION

The present invention concerns a hair treatment applicator for applying a thickened hair treatment productcomposition onto hair. The applicator of the present invention is designed for long and/or curly hair, and especially for long curly hair.

The applicators comprise a handle and a head connected to the handle, the head having a body and a retaining structure for the thickened hair treatment product. The handle is preferably elongated to facilitate use by the consumer. The retaining structure comprises at least one pair of opposed blades extending downwardly from the base of the head body proximate the edge of the base and substantially parallel to the direction of use of the applicator, the at least one pair of opposed blades defining a retaining volume for holding the thickened hair treatment product composition.

As used herein the direction of use of the applicator is the direction in which the applicator is pulled or pushed during use. Generally, and in the embodiment illustrated in FIGS. 1 through 6, the axis of use is the longitudinal axis Y shown in FIG. 6 of the handle 20, as the handle is elongated to facilitate use. In the embodiments shown in FIGS. 1 through 6, the preferred and intended direction of use of applicator 10 containing the treatment composition is generally in the direction of the arrow A (FIG. 6), although it is also possible to use the applicator 10 in the opposite direction. It should of course be appreciated that the applicator 10 does not have to be used on the hair of the user in a straight line. Rather, the applicator may be used in arcuate paths on the hair of the user, so long as the pathways 170, 180 (FIG. 3) are generally in the direction of use.

Figure 4:
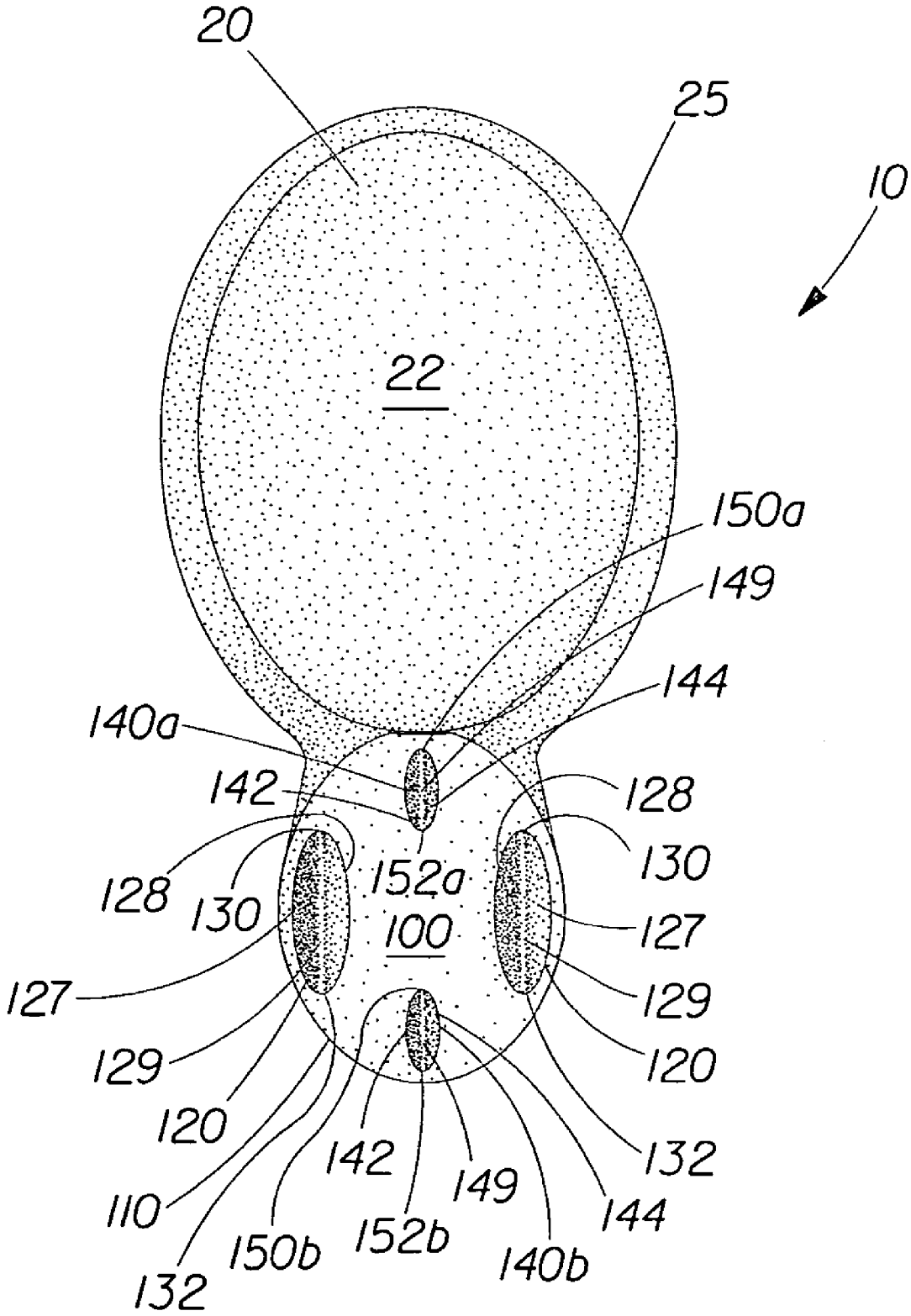
FIG. 4 is a bottom of the applicator of FIG. 1.
Figure 5:
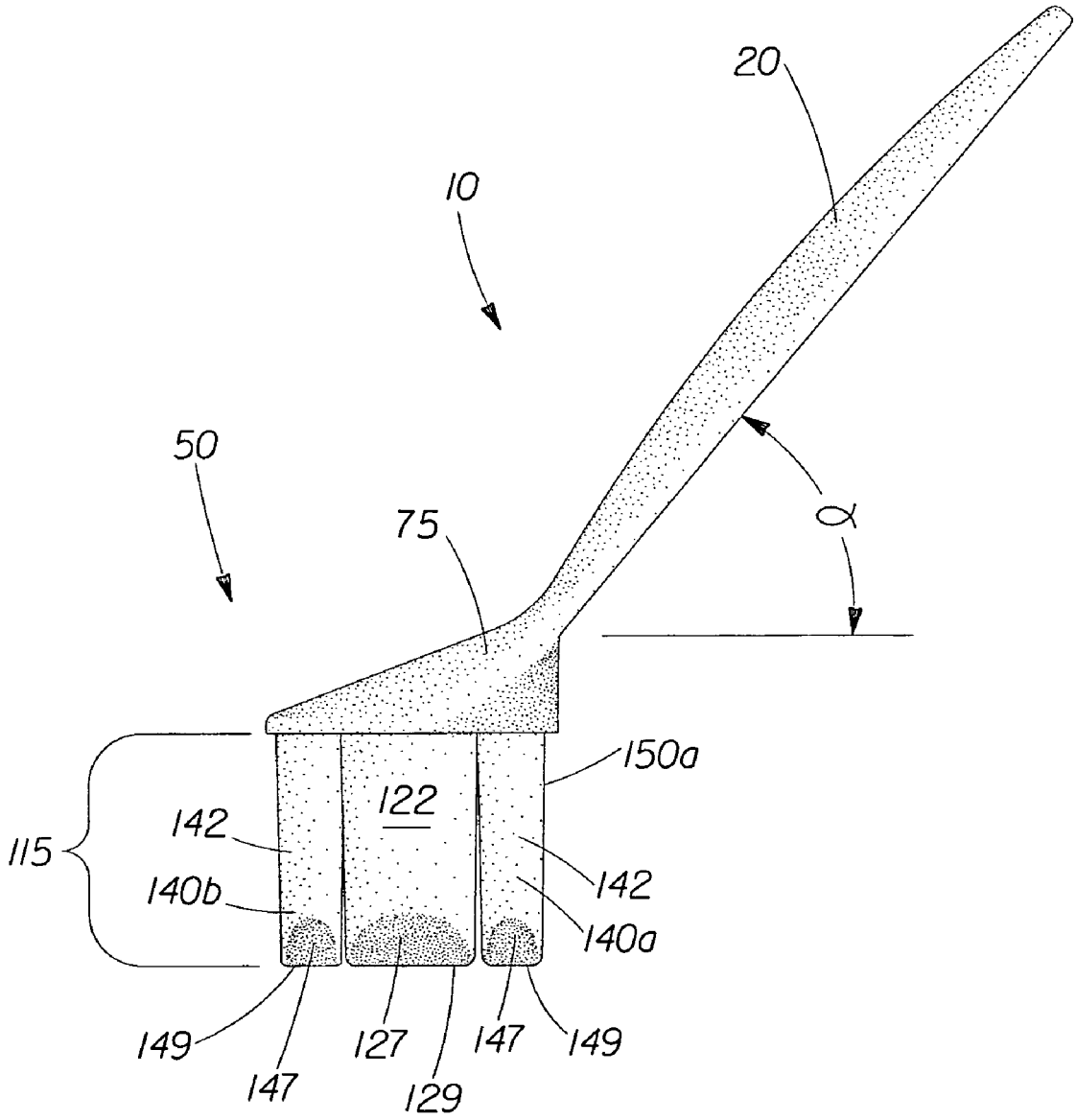
FIG. 5 is a side view of the applicator of FIG. 1.
Figure 6:
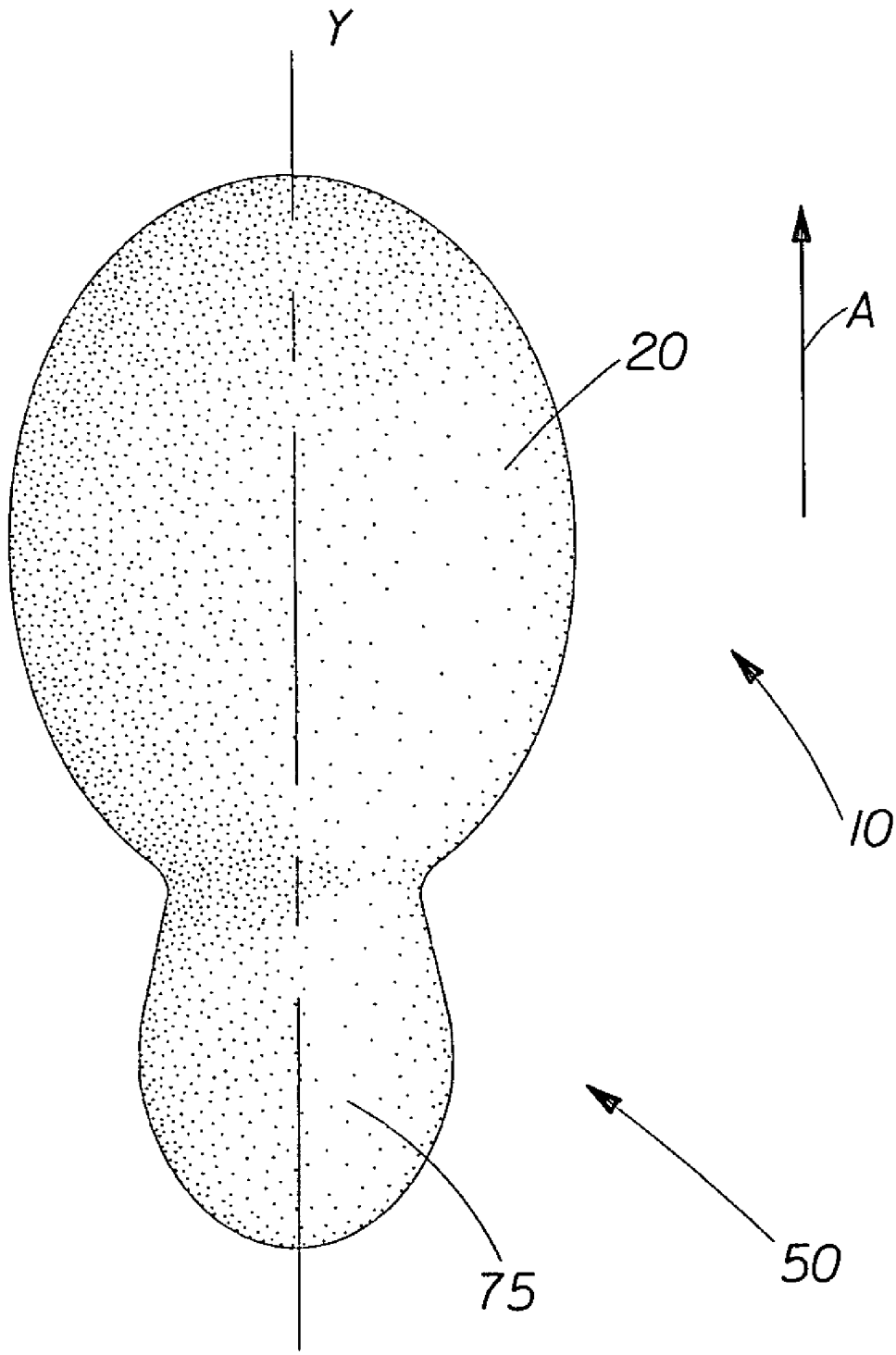
FIG. 6 is a rear view of the applicator of FIG. 1.

Referring to the drawing FIGS. 1 through 6, there is shown an embodiment of a hair treatment applicator of the present invention generally represented by reference numeral 10. Applicator 10 has a handle 20 and a head 50 connected to the handle, the applicator being intended for use in the direction of arrow A as shown in FIG. 6. Preferably, handle 20 and head 50 are integrally molded or formed together.

Handle 20 is an elongated handle that a user grasps in his or her hand when passing head 50 along the user's hair, as will be discussed later in detail. Handle 20 can be any type of handle known in the art that is secured to, or integrally molded or formed with, head 50. Handle 20 is preferably ergonomically designed and contoured to maximize comfort and efficiency for a user due to the repetitive motion of applicator 10 as it passes along or strokes the user's hair. In the drawings a handle 20 embodiment is shown that is oval in configuration, and that extends from the head 50 at an angle $\alpha$ of from about 0° to about 60°, preferably 30° to 45°, especially 45°, as most clearly shown in FIG. 5. As most clearly shown in FIG. 4, handle 20 has a recess 22 defined by raised circumferential surface 25. Recess 22 is adapted to receive the thumb of an individual who is treating his or her own hair.

Figure 1:
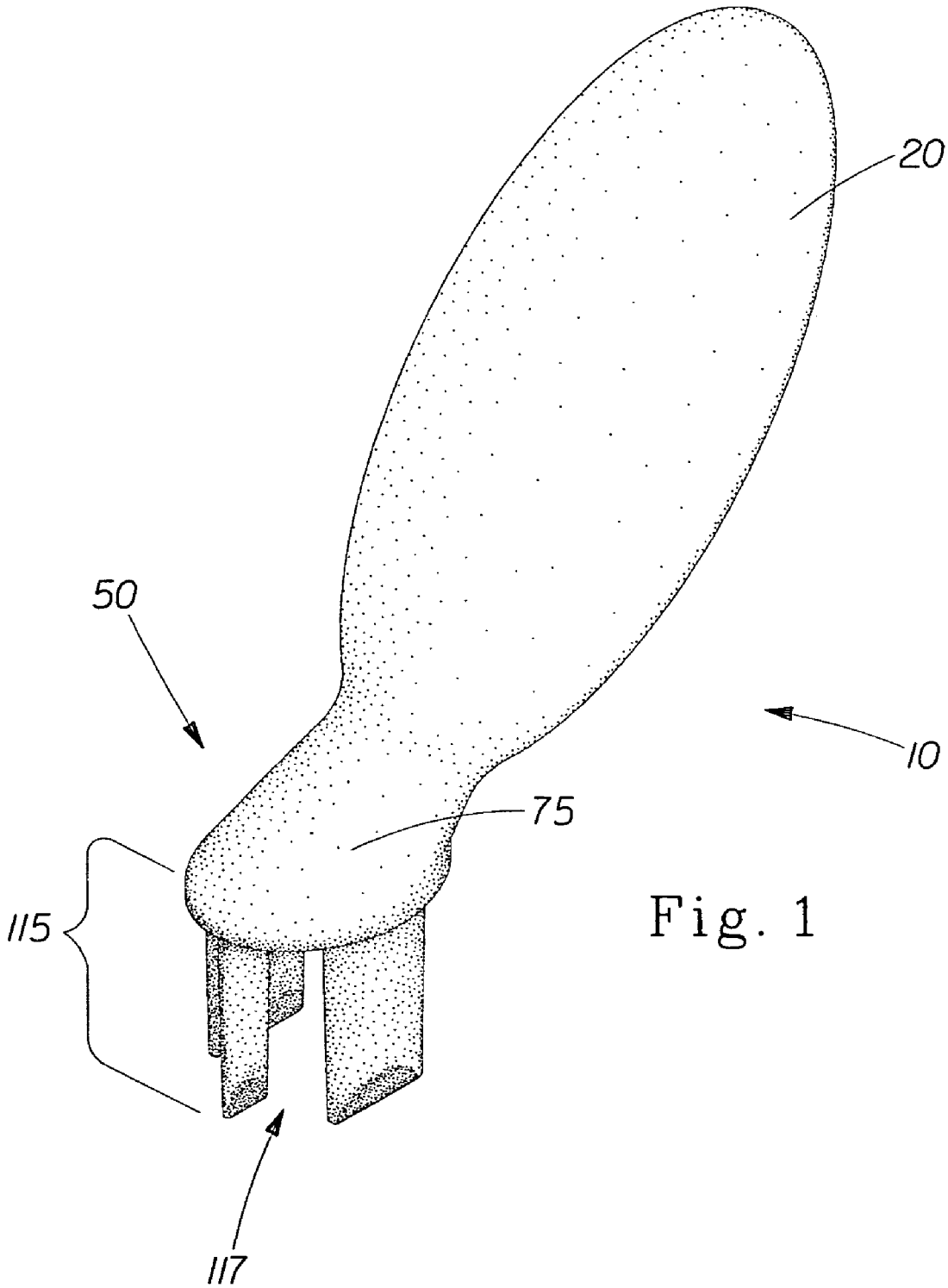
FIG. 1 is a front perspective view of the hair treatment applicator of the present invention, viewed from the right side.
Figure 2:
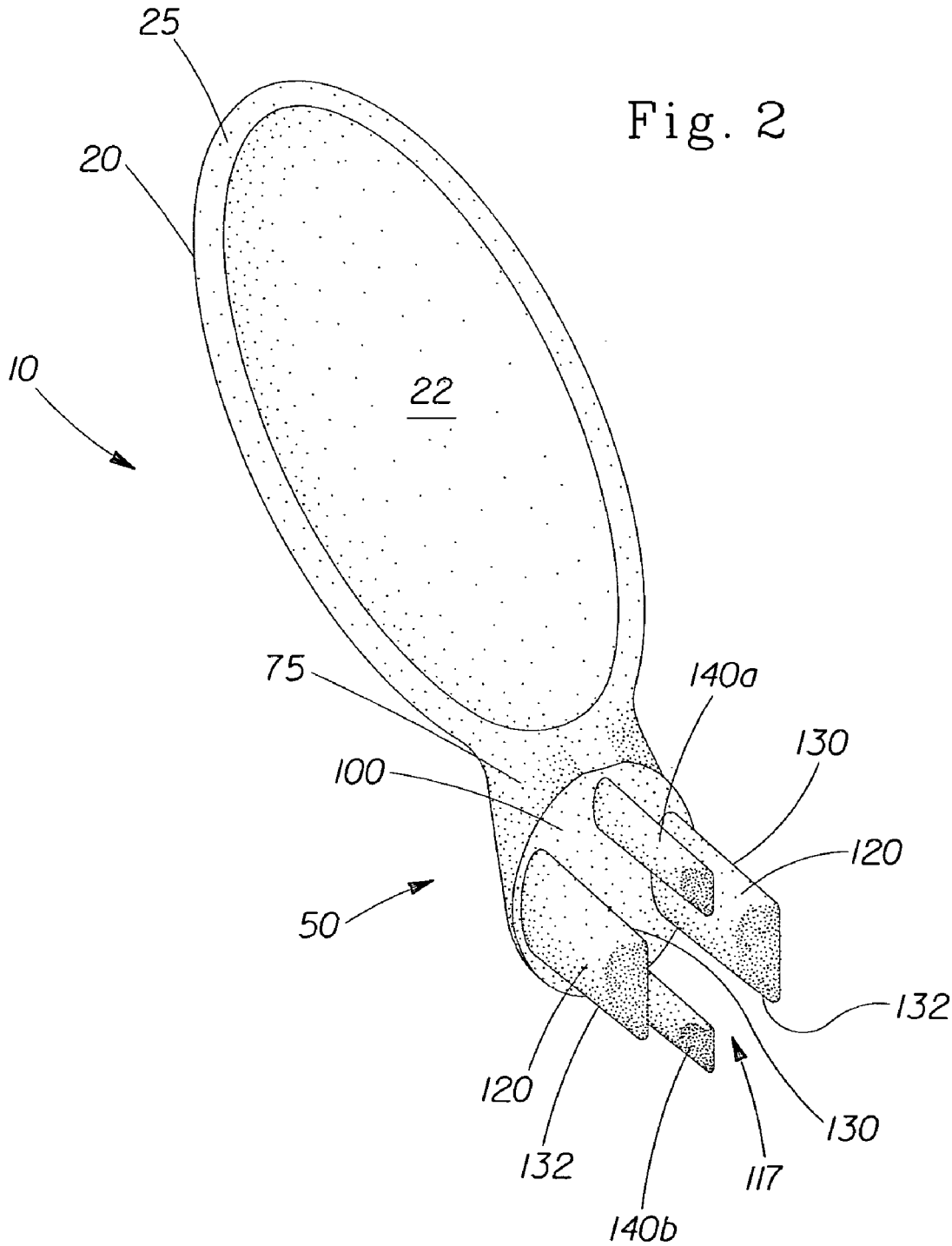
FIG. 2 is rear perspective view of the applicator of FIG. 1.
Figure 3:
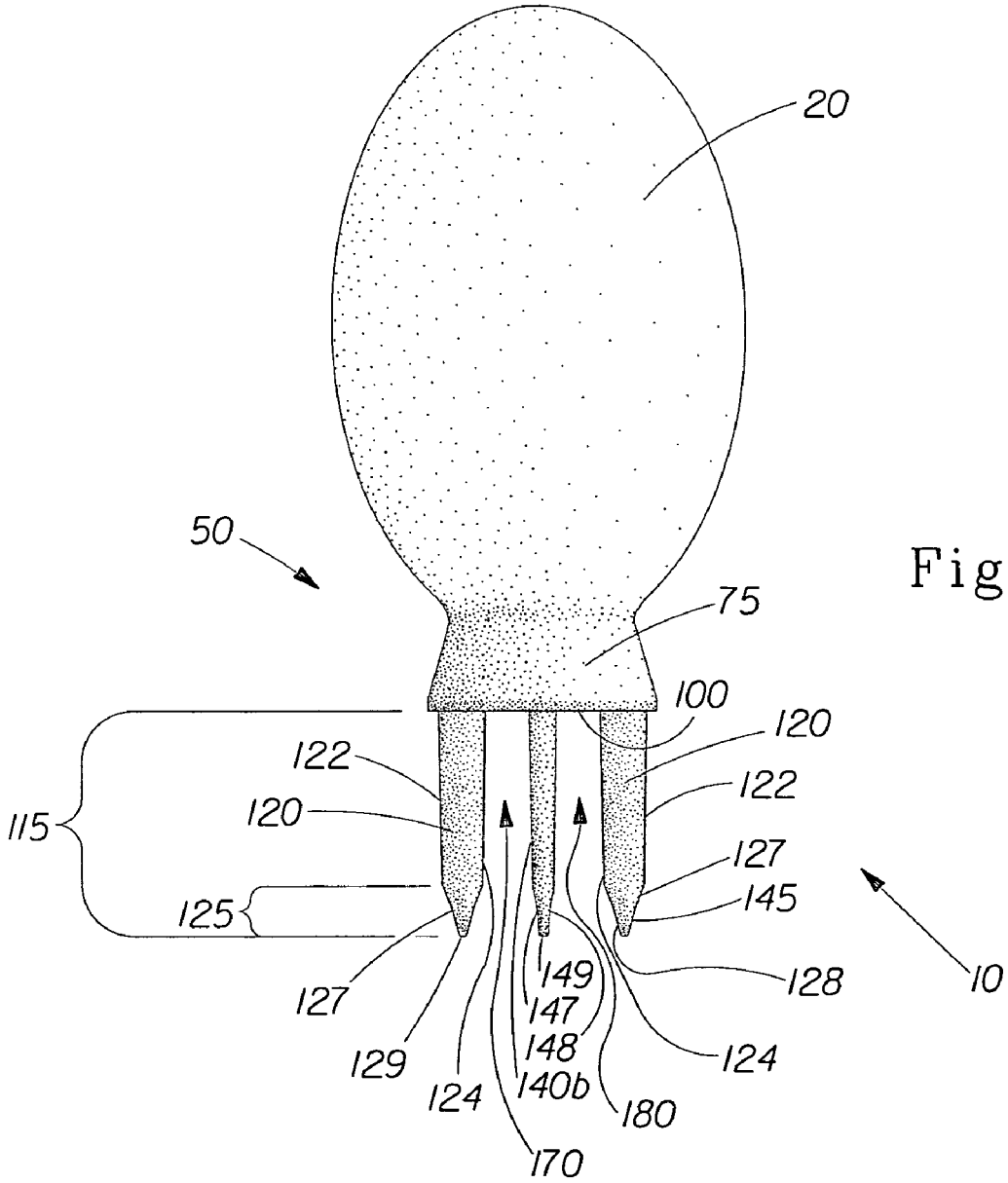
FIG. 3 is a front view of the applicator of FIG. 1.

Referring to FIGS. 1 through 6, head 50 has a symmetrical shape and comprises a body 75 having a base 100 as most clearly shown in FIGS. 2 and 4. Preferably, base 100 is oval in shape, with the major axis of the oval base coincident with the longitudinal axis Y of the handle 20. A first pair of opposed blades 120 extend downwardly from base 100. As best shown in FIGS. 3 and 4, opposed blades 120 have outer surfaces 122 and inner surfaces 124, with the ends 125 distal from the base 100 being provided with outer and inner bevel surfaces 127, 128, respectively. The bevel surfaces 127, 128 form chiseled edge 129 extending from the leading edge 130 to the trailing edge 132 of each blade 120. As used herein the leading edge is the edge proximate to the intended direction of use, which is proximate to handle 20 for the illustrated embodiment.

The first pair of opposed bades 120 define a retaining structure 115 for containing a retaining volume 117 of the hair treatment product, as most clearly shown in FIGS. 1 and 2.

The first pair of opposed blades 120 are positioned proximate the edge 110 of the base 100 and parallel to the longitudinal axis Y. When the base 100 is oval in configuration, the blades 120 are also parallel to the major axis of the base 100. The blades 120 generally have a rectangular configuration as viewed from the side, as shown by blade 120*a* in FIG. 5. Preferably, the blades 120 have a "pillow" shape, as best shown in FIG. 4. The "pillow" shape ensures that the leading edges 130 of the blades 120 have an airfoil configuration that permits the blade 120 to slice through the hair during use. This is important when applying a hair treatment product composition to long hair, especially long, curly hair. With this configuration, the blade is less prone to entangle the hair, especially the curly hair and most especially the long, curly hair. While the pillow shape is preferred, it is not critical that the trailing edges 132 of blades 120 have the airfoil configuration. The chisel edge 129 permits the applicator 10 to penetrate through the layers of the hair and uniformly deliver hair treatment composition to the hair.

In the preferred embodiment, and especially for applicators intended to apply hair treatment product over wider sections of hair, e.g., sections of hair about ⅜ inch in width or wider, it is desireable to provide one or more additional blades 140 that are also parallel to the direction of use, that is, parallel to the longitudinal axis Y of the illustrated embodiment of FIGS. 1 to 6, but whose sidewall surfaces are not substantially proximate to the edge 110 of the base 100. Most preferably, the one of more blades 140 will be coincident with the axis of the direction of use, that is, coincident with the longitudinal axis Y of the illustrated embodiment and positioned at the front and rear of the base 100, as shown most clearly in FIGS. 2 and 5. When a blade 140 is provided, it is preferable to provide a blade coincident with the longitudinal axis Y that is toward the direction of use, that is, blade 140*a* shown in FIG. 4. Most preferably, an opposed pair of blades 140*a* and 140*b* is provided.

The blades 140 generally have a rectangular configuration as viewed from the side, as shown by blade 140*b* in FIG. 5. Blade(s) 140 have planar surfaces 142 and surfaces 144, with the ends 145 distal from the base 100 being provided with bevel surfaces 147, 148. The bevel surfaces 147, 148 form chisel edge 149 extending from the leading edge 150 to the trailing edge 152 of each blade 140.

Preferably, the blades 140 have a "pillow" shape, as best shown in FIG. 4. The "pillow" shape ensures that the leading edges 150 of the blades 140 have an airfoil configuration that permits the blade to slice through the hair during use. This is important when applying a hair treatment product to long hair, especially long, curly hair. With this configuration, the blade is less prone to entangle the hair, especially the curly hair and most especially the long, curly hair. While the pillow shape is preferred, it is not critical that the trailing edge 152 of blades 140 have the airfoil configuration. The chisel edge 149 permits the applicator 10 to penetrate through the layers of the hair and uniformly deliver hair treatment composition to the hair.

In the preferred embodiment shown in the drawing figures, one pair each of the opposed blades 120 and opposed blades 140 are provided and along base 100 in a square pattern (when the base 100 is circular in configuration) or in a diamond pattern (when the base 100 is oval in configuration), as illustrated in FIG. 4. Preferably, blades 120, 140 are perpendicular to base 100.

Preferably, blades 120, 140 have a height of from about 0.25 inch to about 1.5 inches. More preferably, blades 120, 140 have a height of from about 0.5 inch to about 0.0.75 inch. Preferably, blades 120 have a width of from about 0.2 inch to about 0.75 inch, preferably from about 0.25 inch to about 0.6 inch, as measured, e.g., from leading edge 130 to trailing edge 132. Preferably, the opposed blades 120 have the same height and width. The blades 140 are narrower than the blades 120, preferably being about half as wide as the blades 120, and approximately the same height. Preferably, blades 140 have a width of from about 0.1 inch to about 0.5 inch, preferably from about 0.15 inch to about 0.3 inch, as measured from leading edge 150 to trailing edge 152. Preferably, the blades 140 have the same height and width. The thickness of the blades 120, as measured between surface 122 and surface 124 at their widest point is from about 0.03 inch to about 0.25 inch, more preferably from about 0.1 inch to about 0.2 inch. The thickness of the blades 140, as measured between outer surface 142 and inner surface 144 at their widest point is from about 0.03 inch to about 0.25 inch, more preferably from about 0.06 inch to about 0.1 inch.

The base 100 may be circular but is preferably oval. Suitably the base when circular has a diameter of from about 0.4 inch to about 1.25 inches, preferably from about 0.75 inch to about 1 inch. When oval, the base has a major diameter of from about 0.4 inch to about 1.25 inches, preferably from about 0.75 inch to about 1 inch, while the minor axis has a diameter of from about 0.4 inch to about 1.2 inches, preferably from about 0.65 inch to about 0.75 inch, with the ratio of major diameter to minor diameter being within the range of 1:1 to 2:1, preferably 1.1:1 to 1.3:1.

While the preferred embodiment has a first pair of opposed blades 120 and a second pair of opposed blades 140, alternative numbers of blades 120, 140 can also be used. Pairs of blades are not critical. Blades 120, 140 are disposed along base 100 such that the side surfaces 122, 124, 142 and 144 are substantially parallel to the longitudinal axis Y of handle 20.

In use, hair flow is between opposed blades 120 parallel to the longitudinal axis of handle 20, and to either side of surfaces 142, 144 of opposed blades 140, in the direction of arrow A (FIG. 6). The diamond pattern of blades 120, 140 is preferred because it provides for a more even distribution of the hair treatment product composition that is held between the blades. However, alternative patterns or shapes for the arrangement of blades 120, 140 along base 100 can be used, including rectangular patterns. Preferably, pathways 170, 180 are between about 0.2 inch to about 1 inch wide. More preferably, spaces 170, 180 are between about 0.3 inch to about 0.6 inch wide.

In the preferred embodiment, base 100, blades 120 and blades 140 define a retaining volume or reservoir 117. In use, retaining volume 117 is filled with the hair treatment product composition that is to be applied to the user's hair. As the applicator containing the hair treatment product composition is pulled through the hair of the individual receiving the treatment, the applicator being pulled in the intended direction of use, i.e., in the direction of Arrow A, the hair passes through the retaining volume 117 through pathways 170, 180. The "pillow" shape of the blades 120, 140 facilitate use of the applicator on long hair and curly hair, in particular on long, curly hair. Thus, the leading edge 150*a* of the blade 140*a* knifes through the hair, and untangles long and curly hair. Similarly, the leading edges 130 of opposed blades 120 knife through the long or curly hair to which the hair treatment product composition is being applied. Hair that passes within the retaining volume 117 is treated with an application of the hair treatment product composition, while hair on either outer surface 126 of each blade 120 is not so treated. Nonetheless, it is important in the case of long and curly hair that the hair to be treated and hair adjacent to such hair be detangled and separated prior to contact with the product, which is accomplished by means of the applicator disclosed herein. In the same manner the bevel edges 129, 149 of blades 120, 140 allow the applicator to penetrate through the layers of the long and curly hair. Additional pathways 170 or 180 are possible by providing one or more additional blades 120 or 140.

Applicator 10 is preferably injection molded as a single piece. Applicator 10 can be made from any moldable material, such as, for example, polyethylene or polypropylene.

The applicator is particularly useful in applying a hair bleach product or a hair dye product to the hair, to provide highlights or other hair color effect to the hair. Such highlighting or dyeing effect is difficult to achieve with conventional combs because the hair tends to layer and/or entangle, thus preventing uniform distribution of the hair dye or hair bleach product.

The hair bleach (i.e., hair lightening) product is adapted to provide sufficient lightening within a given period of time so that hair may be bleached to a lighter, and preferably a blonde shade. Typically, a hair bleach treatment product used with the applicator of the present invention to provide hair highlights or streaks of lightened hair to the user comprises a three part hair bleaching system comprising (a) a peroxide solution, generally referred to as the developer component; (b) a powder activator component, also referred to as a lightening powder or a booster, and (c) an alkalizing agent component.

These three components (a), (b) and (c) are typically provided in the form of a kit, which typically would also include the applicator of the present invention, and which may further include instructions for use, gloves, a hair pretreatment component, and a hair post treatment component. The three essential components (a), (b) and (c) of the hair bleach product kit are admixed at the time of use, typically in a container that is separately part of the kit, or that is provided as the container for one of the three components (a), (b) or (c).

The developer component composition comprises a hydrogen peroxide solution. The solution contains from about 3 to about 12%, preferably 6 to 12%, most preferably about 9% by weight hydrogen peroxide, and further preferably contains additional ingredients to facilitate its use and performance, e.g., one or more of a thickener, an emulsifier, or a hair conditioning agent, each being present in the developer component in sufficient amount to provide its intended function in the developer component composition or in the hair bleach product composition obtained when the developer component is mixed with the activator powder component and the alkalizing agent component. Suitable thickeners for hair bleach and hair dye developer compositions are well known in the art. The pH of the developer component is generally in the range of from about 2.5 to about 5.5, especially about 3 to about 4.

The powder activator component of the present invention comprises an alkali metal persulfate selected from the group consisting of sodium persulfate, potassium persulfate, ammonium persulfate, and mixtures thereof. The powder activator component contains from about 40 to about 80%, preferably 50 to 70%, of the persulfate by weight of the activator component composition. The preferred persulfate is a mixture of ammonium persulfate and potassium persulfate. The powder activator component further contains an alkalinity agent to ensure an alkaline bleach product when the product components are mixed. Suitably, the alkalinity agent is sodium silicate present in the activation powder component in an amount of from about 20 to about 50% by weight of the powder activator component composition, preferably from about 30 to 40% by weight. In formulating the powder activator component the requisite rheological and viscosity properties of the hair bleach product composition as hereinafter described should be taken into account.

The third component of the hair bleach system is the alkalizing agent component. The alkalizing agent in the alkalizing agent component is selected from the group consisting of ammonium hydroxide, monoethanolamine, and mixtures thereof. This component composition generally has a pH of from about 8 to 12. Generally, the alkalizing agent is present in an amount of from about 3 to about 25% by weight of the alkalizing agent component, depending upon the alkalizing agent used. Preferably, the alkalizing agent component is in the form of a thickened liquid, a gel or a cream. In formulating the alkalizing agent component and especially in selecting the thickening agent, consideration should be given to the selection of the thickener component(s) that will achieve the requisite theological and viscosity properties of the hair bleach product composition as hereinafter described.

In use, the applicator 10 laden with hair bleach product composition is pulled through the hair to be treated and the hair passes through opposed pathways 170, 180. The hair bleach product composition is retained in the retaining volume 200 in light of its thixotropic rheological properties, as hereinafter described.

The hair bleach product composition applied to the hair (i.e., the mixture of the three components) has a rheology such that it sets up when no shear forces are acting upon it, but under moderate shear stress begins to flow but with a viscosity that is sufficiently high to avoid dripping and running down the face and neck of the person having his or her hair lightened. Generally, this rheology is referred to as thixotropic, or shear-thinning. The viscosity of the hair bleach product composition is from about 20,000 to about 60,000 cps, preferably from about 30,000 to about 45,000 cps. at 25° C. and atmospheric pressure as measured by a Brookfield LVT viscometer using an appropriate spindle at a proper speed. A more detailed description of hair bleach products suitable for application to hair with the applicator of the present invention is found in U.S. patent application Ser. No. 10/392,989 filed Mar. 20, 2003 by assignee of the present invention and incorporated herein by reference. The applicator of the present invention may be used with the product Herbal Essences Highlighting sold by assignee herein.

The powder activator composition, the developer component, and the alkalizing agent component are added to a mixing vessel, and blended together. When a uniform mixture has been obtained, the hair bleach composition, when all shear forces have been removed, has a paste-like consistency. This composition may be scooped-up and placed into the retaining volume 200 of the applicator 10, or applied through a nozzle attached to the mixing vessel and into the applicator retaining volume. The hair bleach product composition is retained in the retaining volume 200 because of its rheology and the absence of shear forces acting upon it. The user then applies the hair bleach product composition to the hair by pulling the applicator, specifically the head of the applicator and its product composition laden reservoir, through the hair in a uniform smooth motion. This process may be repeated to provide additional streaks and/or highlights to the hair.

The hair bleach product composition is allowed to remain on the hair for a discreet amount of time, depending on the color of the hair being treated and on the desired final shade of the hair. This is generally from about 5 minutes to about one hour, preferably 10 minutes to 45 minutes. When the desired shade is obtained, the hair is shampooed and/or rinsed. At this time any post-treatment composition, e.g., conditioner, etc. may be applied to the hair.

The present invention having been thus described with particular reference to the preferred forms thereof, it will be obvious that various changes and modifications may be made therein without departing from the spirit and scope of the present invention as defined herein.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hair treatment applicator for applying a hair treatment product composition to hair of a user by passing the applicator through the hair in a predetermined direction, the applicator comprising:

an elongated handle having a longitudinal axis; and a head connected to said handle, the head comprising a body and a retaining structure, the body having a base with edges and the retaining structure consisting of a first pair of opposed, pillow-shaped blades, each blade having a distal end and a proximal end, the proximal end being attached to the base and the blade extending downwardly from the base, wherein each blade is perpendicular to the base and disposed proximate the edges of the base and wherein the distal end of each blade is beveled, the first pair of opposed blades being disposed parallel to the longitudinal axis of the handle, and a second pair of opposed blades, each blade having a distal end and a proximal end, the proximal end being attached to the base and the blade extending downwardly from the base, wherein each blade is perpendicular to the base, disposed proximate the edges of the base, and essentially coincident with the longitudinal axis of the handle, said first and second pairs of opposed blades defining a retaining volume adapted to receive the hair treatment product composition whereby in use the applicator passes through the hair towards and essentially along the longitudinal axis of the handle.

2. The applicator of claim 1 wherein the first and second pairs of opposed blades have rectangular planar shapes.

3. The applicator of claim 1 wherein said retaining volume is about 0.4 inch to about 2 inch in width.

4. A hair treatment applicator for applying a hair treatment product composition to hair of a user by passing the applicator through the hair in a predetermined direction, the applicator comprising:

a handle having a longitudinal axis; and a head connected to said handle, the head comprising a body and a retaining structure, the body having a base with edges and the retaining structure consisting of a first pair of opposed, pillow-shaped blades, each blade having a distal end and a proximal end, the proximal end being attached to the base and the blade extending downwardly from the base, wherein each blade is perpendicular to the base and proximate the edges of the base and wherein the distal end of each blade is beveled, and the pair of blades being parallel to the longitudinal axis of the handle, and a second pair of opposed, pillow-shaped blades, each blade having a distal end and a proximal end, the proximal end being attached to the base and the blade extending downwardly from the base, wherein each blade is perpendicular to the base, disposed proximate the edges of the base, and essentially coincident with the longitudinal axis of the handle, the retaining structure comprising a hair treatment composition selected from the group consisting of a hair bleach composition and a hair dye composition, whereby in use the applicator passes through the hair towards and essentially along the longitudinal axis of the handle.

5. The applicator of claim 4 wherein the opposed blades have rectangular planar shapes.

6. The applicator of claim 4 wherein the leading edges of the opposed blades have airfoil configurations.

* * * * *